United States Patent [19]

Chester

[11] Patent Number: 4,629,265

[45] Date of Patent: Dec. 16, 1986

[54] CABINET CONSTRUCTION

[75] Inventor: Richard J. Chester, Kennedy, N.Y.

[73] Assignee: American Locker Group Incorporated, Jamestown, N.Y.

[21] Appl. No.: 656,278

[22] Filed: Oct. 1, 1984

[51] Int. Cl.[4] ..... E05D 7/10

[52] U.S. Cl. ..... 312/329; 16/263; 16/379; 49/398; 49/465

[58] Field of Search ..... 312/138 R, 329, 293, 312/325; 49/398, 465; 16/261, 262, 273, 379, 386

[56] References Cited

U.S. PATENT DOCUMENTS

| | | | |
|---|---|---|---|
| 1,719,151 | 7/1929 | Wathey | 49/371 |
| 1,806,120 | 5/1931 | Schiff | 312/329 |
| 2,933,016 | 4/1960 | Kunde et al. | 16/261 |
| 3,952,369 | 4/1926 | Erickson | 16/171 |

*Primary Examiner*—William E. Lyddane
*Assistant Examiner*—Joseph Falk
*Attorney, Agent, or Firm*—Bean, Kauffman & Bean

[57] ABSTRACT

An improved cabinet door mounting arrangement is disclosed, which allows removable mounting of one or more doors on a common hinge pin without requiring removal of the hinge pin from a cabinet.

15 Claims, 3 Drawing Figures

Fig. 1.
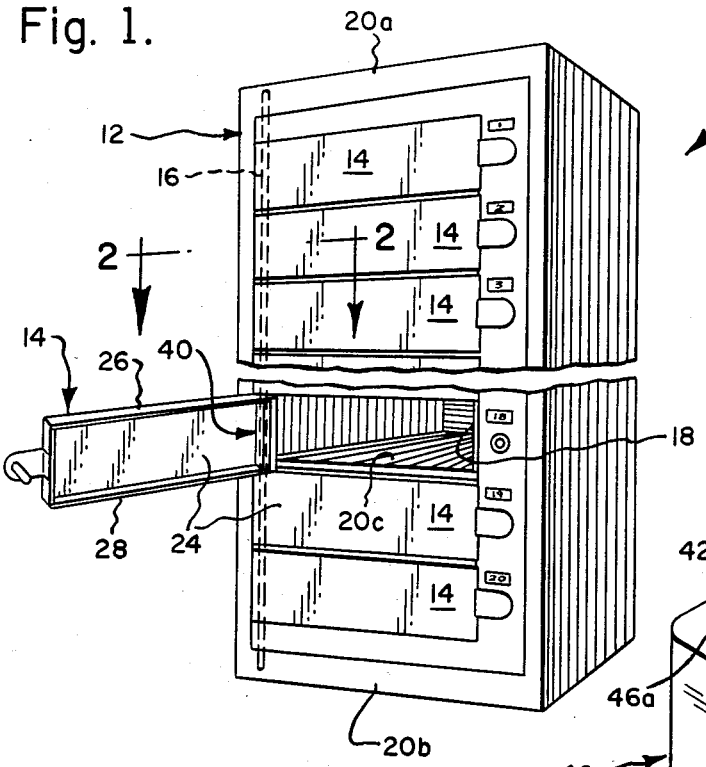
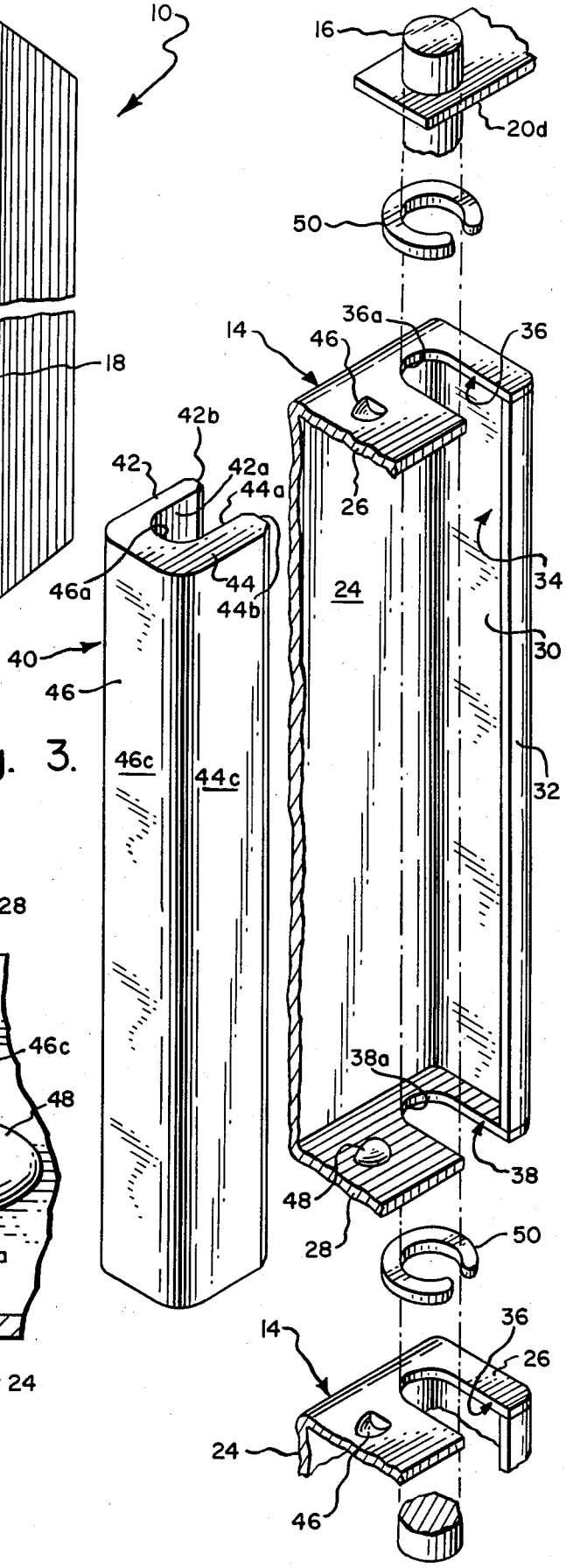
Fig. 3.
Fig. 2.
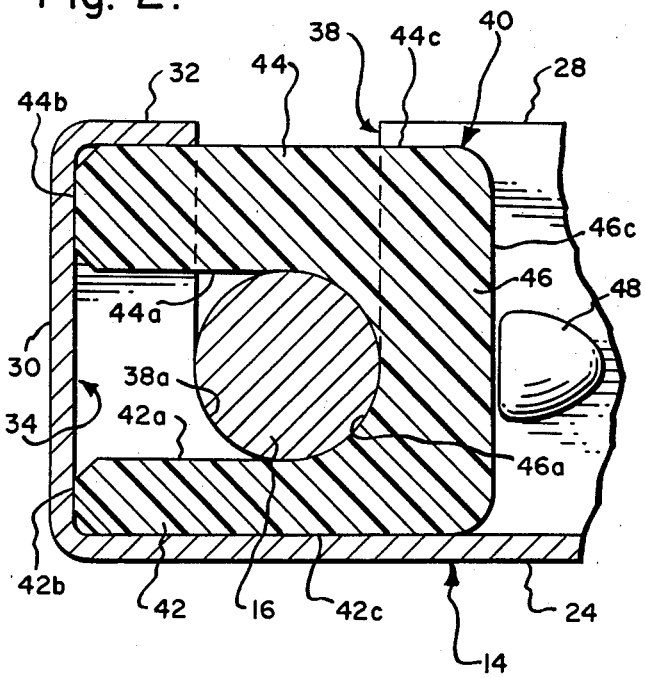

CABINET CONSTRUCTION

BACKGROUND OF THE INVENTION

In certain prior cabinet constructions, such as those adapted for use as coin or otherwise operated security lockers, a common hinge pin has been employed for mounting a plurality of cabinet doors for independent swinging movements between closed and open positions. Several drawbacks of prior cabinet constructions employing a common hinge pin have been recognized, including the difficulty associated with replacing individual cabinet doors, which become damaged during use. Specifically, in prior constructions of which I am aware, it was necessary to a least partially remove the hinge pin from the cabinet, the damaged door and possibly one or more adjacent, undamaged doors, depending on the placement of such damaged door in a column of doors, each time a damaged door is required to be removed from the cabinet; the installation of a replacement door requiring returning of the hinge pin to its initial position after threading thereof through the hinge pin bearing openings of such replacement door and adjacent, undamaged doors.

SUMMARY OF THE INVENTION

The present invention is directed towards an improved cabinet construction, wherein a door may be selectively, removably mounted on a cabinet without requiring removal of a door mounting hinge pin from the cabinet and/or removable threading of such hinge pin through other cabinet doors for which it may serve as a common hinge mount.

In accordance with the present invention, a cabinet is provided with a hinge pin permanently fixed within the cabinet at the time of manufacture and one or more doors are removably mounted on such hinge pin without disturbing the position of such hinge pin or that of any other door supported thereby.

More specifically, the present invention contemplates providing each door with mounting means defining a mounting slot adapted to receive a hinge pin when the door is moved transversely thereof and retaining means for releasably retaining the hinge pin within the mounting slot and cooperating therewith to support the door on the hinge pin for swinging movements between its open and closed positions. The retaining means includes a bearing retainer preferably adapted to be snap-fitted within a mounting seat defined by the door in a manner facilitating the removable mounting thereof.

DRAWINGS

The nature and mode of operation of the present invention will now be more fully described in the following detailed description taken with the accompanying drawings wherein:

FIG. 1 is a front elevational view of a storage or security cabinet having a plurality of doors supported in accordance with the present invention;

FIG. 2 is a sectional view of one of the cabinet doors taken generally along the line 2—2 in FIG. 1; and FIG. 3 is an exploded perspective view showing the rear of the cabinet door adapted for mounting on a hinge pin in accordance with the present invention.

DETAILED DESCRIPTION

Reference is first made to FIG. 1, wherein a storage cabinet is generally designated as 10 and shown as including a frame 12 on which one or more doors 14 are mounted for swinging movement about the axis of a common hinge pin 16 for purposes of selectively affording access to cabinet storage compartments via forwardly facing access openings 18. As desired, suitable locking mechanisms may be provided to releasably lock doors 14 in their access opening closed positions, while permitting swinging movement of such doors on hinge pin 16 into access opening open positions.

Cabinet frame 12 may be of any desired construction, but is shown in part for purposes of reference as including horizontal, upper and lower frame members **20*a* and 20*b*, which cooperate with shelves 20*c* to vertically bound access openings 18. The upper and lower ends of hinge pin 16 may be supported by frame members 20*a* and 20*b* in any suitable manner; it being understood that if desired the hinge pin may be permanently fixed in position within the frame at the time of cabinet manufacture, since the present invention permits removable mounting of doors 14 on the hinge pin without removal or adjustments of the latter. If desired, frame 12 may be fitted with apertured flanges 20*d* shown only in FIG. 3, which serve to prevent horizontally directed flexures of hinge pin 16 intermediate its upper and lower ends. Hinge pin 16 may be cylindrical, as shown in FIGS. 2 and 3**.

One of doors 14 is shown in part in FIGS. 2 and 3 as including a front panel 24, an upper edge panel 26, a lower edge panel 28, an end panel 30 and a rear locking tab 32. Typically, doors 14 are formed from sheet metal, such that panels 26, 28 and 30 are integrally joined to the upper, lower and one of the end marginal edges of front panel 24, and rear locking tab 32 is integrally joined to the rear edge of end panel 30. Rear locking tab 32 cooperates with the front panel 24 and end panel 30 to create or define a mounting seat 34 whose function will hereinafter be described.

By again referring to FIGS. 2 and 3, it will be understood that doors 14 are each provided with a slot means, such as may be defined by a pair of vertically aligned and rearwardly opening slots 36 and 38, which are preferably formed in upper and lower edge panels 26 and 28, respectively, and disposed in a spaced, parallel relationship to the upper and lower ends of end panel 30. Slots 36 and 38 are transversely dimensioned to slidably receive hinge pin 16, as an incident to transversely directed movements of door 14 relative thereto, and have arcuate inner ends or edges **36*a* and 38*a*, shaped to rotatably bear on the surface of the hinge pin. The depth of slots 36 and 38, and thus the required widths of edge panels 26 and 28, is necessarily sufficient to space hinge pin 16 forwardly of the rear edges of such edge panels, when the hinge pin is arranged in engagement with slot inner ends 36*a* and 38*a*, as best shown in FIG. 2. With slots 36 and 38 arranged in the manner illustrated in FIGS. 2 and 3, mounting seat 34 may be considered to open towards the slots in a direction extending transversely thereof. If desired, mounting seat 34 and/or slots 36 and 38 may be defined by a separately formed unit, not shown, suitably fixed to the rear of front panel 24**.

Hinge pin 16 may be removably fixed within slots 36 and 38 by use of a bearing retainer 40 having a generally U-shaped cross section defined by a pair of legs 42 and 44 joined by a base 46. As best shown in FIG. 2, bearing retainer 40 is shaped and sized, such that legs 42 and 44 straddle hinge pin 16 to position same in bearing engagement with leg inner surfaces 42*a* and 44*a* adjacent their juncture with base arcuate inner surface 46*a*, when the free ends of such legs are inserted or seated within mounting seat 34 in the manner shown in FIG. 2. When bearing retainer 40 is thus positioned, inner surfaces 42*a*, 44*a* and 46*a* cooperate with slot inner ends 36*a* and 38*a* to define a bearing surface or surfaces rotatably engaging with hinge pin 16 for purposes of mounting door 14 for swinging movement between access opening closed and open positions shown for example in FIG. 1. Preferably, legs 42 and 44 have a length sufficient to permit their free end faces 42*b* and 44*b* to bottom out or abut against the inner surface of end panel 30, and retainer 40 has an overall width, as measured between leg outer surfaces 42*c* and 44*c*, sufficient to place such outer surfaces in surface-to-surface engagement with the rear surface of front panel 24 and the front surface of rear locking tab 32, respectively, when the bearing retainer is properly seated within mounting seat 34 in the manner shown in FIG. 2. Bearing retainer 40 may be suitably positioned or supported within mounting seat 34 in a direction extending axially of hinge pin 16, such as by forming the retainer of a length sufficient to permit its upper and lower ends to reside in proximity to facing surfaces of upper and lower edge panels 26 and 28. Bearing retainer 40 may be formed from any suitable material chosen primarily for its bearing properties.

Bearing retainer 40 may be fixed in position within mounting seat 34 and attached to door 14 by any suitable means, but preferably such means would allow for removable mounting of the bearing retainer so as to permit removable mounting of its associated door 14 on hinge pin 16. A presently preferred means for achieving this end includes providing upper and lower edge panels 26 and 28 with means, such as may be defined by detents 46 and 48 projecting from facing surfaces of such panels and arranged to engage with base outer surface 46*c* adjacent the upper and lower ends of bearing retainer 40; and by providing edge panels 26 and 28 with a degree of resiliency sufficient to permit snap-fitting of the retainer over and past such detents, as the bearing retainer is moved for seated engagement within mounting seat 34. Detents 46 and 48 may take various forms, but are preferably defined by a localized deforming of upper and lower edge panels 26 and 28, as by a stamping operation, to provide facing projections shaped to define ramps coverging in the direction of slots 36 and 38, so as to facilitate resilient deformation of the edge panels, as bearing retainer 40 is moved towards mounting seat 34, and upstanding stop or abutment surfaces arranged relatively adjacent the slots for abutting engagement with base outer surface 46*c* upon proper seating of the bearing retainer in order to normally prevent removal thereof. With this arrangement, detents 46, 48 and/or edge panels 26, 28 may be deformed by use of a hammer or convenient tool, not shown, in the event it is desired to remove bearing retainer 40 for door dismounting and replacement purposes. Resiliently deformable flexure of the sheet metal from which edge panels 26 and 28 are formed is facilitated by the presence of slots 36 and 38 in proximity to detents 46 and 48, and, if desired, by not attaching, as by welding, the ends of such edge panels to end panel 30 and tab 32. In any event, it is desired that the detents be shaped and the resiliency of the edge panels 26 and 28 be controlled to allow for ease of installation, while at the same time rendering difficult unauthorized removal of the bearing container, and thus its associated door, except by an authorized attendant.

Alternatively, it is anticipated that bearing retainer 40 may be formed from a plastic material, such as nylon, having a sufficient degree of resiliency to permit snap-fitting thereof into seated position without requiring flexure of edge panels 26 and 28, or that detents 46 and 48 may be shaped or mounted on the edge panels in a manner permitting resilient flexures thereof for bearing retainer mounting purposes.

The arrangement of slots 36 and 38 and mounting seat 34 is such that loads imposed on door 14 when in open position, such as due to a patron leaning on an open door or placing a heavy suitcase or package thereon, are transferred to hinge pin 16 primarily by upper and lower edge panels 26 and 28, such that little or no loads are applied to bearing retainer 40, such as might otherwise tend to dislodge same from within mounting seat 34, regardless of the above-mentioned means employed to permit snap-fitting thereof into seated position.

Again referring to FIG. 3, it will be noted that in accordance with the present invention, bearing-spacer bushings 50, which are normally provided in cabinets for purposes of spacing doors 14 from each other or adjacent portions of frame 12 are preferably of C-shaped configuration, so as to allow same to be snapped onto hinge pin 16 after installation of the latter. This obviates necessity of threading the hinge pin through the bushings, as an incident to initial hinge pin installation, and permits damaged, worn or defective bushings to be subsequently replaced without removal of the hinge pin from the cabinet.

What is claimed is:

1. A cabinet construction comprising a frame defining at least one cabinet access opening; at least one door for closing said access opening; a hinge pin carried by said frame; and mounting means for removably mounting said door on said hinge pin for swinging movement between access opening closed and open positions, said mounting means including slot means on said door sized to slidably receive said hinge pin when said door is moved transversely thereof and retaining means attached to said door for releasably retaining said hinge pin within said slot means and cooperating therewith to support said door on said hinge pin for said swinging movement, said retaining means includes a bearing retainer snap-fit attached to said door and arranged to cooperate with said slot means to define a bearing surface rotatably supporting said door on said hinge pin.

2. A cabinet construction comprising a frame defining at least one cabinet access opening; at least one door for closing said access opening; a hinge pin carried by said frame; and mounting means for removably mounting said door on said hinge pin for swinging movement between access opening closed and open positions, said mounting means including slot means on said door sized to slidably receive said hinge pin when said door is moved transversely thereof and retaining means attached to said door for releasably retaining said hinge pin within said slot means and cooperating therewith to support said door on said hinge pin for said swinging movement, said slot means opens rearwardly of said door, said retaining means includes a bearing retainer of U-shaped cross section having leg portions thereof extending transversely of said slot means and cooperating therewith to define a bearing surface rotatably engaging with said hinge pin and means for releasably attaching said bearing retainer to said door, said means for releasably mounting said bearing retainer is resiliently deformable.

3. A cabinet construction comprising a frame defining at least one cabinet access opening; at least one door for closing said access opening; a hinge pin carried by said frame; and mounting means for removably mounting said door on said hinge pin for swinging movement between access opening closed and open positions, said mounting means including slot means on said door sized to slidably receive said hinge pin when said door is moved transversely thereof and retaining means attached to said door for releasably retaining said hinge pin within said slot means and cooperating therewith to support said door on said hinge pin for said swinging movement, said slot means opens rearwardly of said door, said retaining means includes a bearing retainer of U-shaped cross section having leg portions thereof extending transversely of said slot means and cooperating therewith to define a bearing surface rotatably engaging with said hinge pin and means for releasably attaching said bearing retainer to said door, said means for releasably mounting said bearing retainer includes detent means carried by edge panels of said door, and said edge panels define said slot means and are resiliently deformable sufficiently to permit snap-fit attachment of said bearing retainer to said door over said detent means.

4. A cabinet construction comprising a frame defining at least one cabinet access opening; at least one door for closing said access opening; a hinge pin carried by said frame; and mounting means for removably mounting said door on said hinge pin for swinging movement between access opening closed and open positions, said mounting means including slot means on said door sized to slidably receive said hinge pin when said door is moved transversely thereof and retaining means attached to said door for releasably retaining said hinge pin within said slot means and cooperating therewith to support said door on said hinge pin for said swinging movement, said retaining means includes a mounting seat carried by the door and arranged adjacent said slot means and to open theretowards in a direction extending transversely thereof, a bearing retainer of U-shaped cross section having a base joining a pair of legs, said legs extend transversely of said slot means and have free ends thereof disposed within said mounting seat to arrange adjacent inner surfaces of said legs and base for cooperation with said slot means to define a bearing surface rotatably engaging with said hinge pin, and means arranged adjacent said slot means remotely of said mounting seat for engagement with said base to retain said free ends of said legs disposed within said mounting seat.

5. A cabinet construction according to claim 4, wherein said means arranged for engagement with said base is resiliently deformable to permit snap-fit mounting of said bearing retainer within said mounting seat.

6. A cabinet construction according to claim 4, wherein said means arranged for engagement with said base are detents carried by said door.

7. A cabinet construction comprising a frame defining at least one cabinet access opening; at least one door for closing said access opening; a hinge pin carried by said frame; and mounting means for removably mounting said door on said hinge pin for swinging movement between access opening closed and open positions, said mounting means including vertically extending slot means on said door sized to slidably receive said hinge pin when said door is moved transversely thereof and retaining means for releasably retaining said hinge pin within said slot means and cooperating therewith to support said door on said hinge pin for said swinging movement, said door includes in part a front panel, upper and lower edge panels, an end panel, and a rear locking tab, said slot means is defined by a pair of aligned slots formed in said upper and lower edge panels and arranged to open rearwardly of said front panel and in a spaced relationship to said end panel, said rear locking tab extends essentially between said slots and said end panel and parallel to said front panel, said rear locking tab and said end panel and said front panel cooperating to define a mounting seat arranged to open towards said slots in a direction extending transversely thereof, and said retaining means includes said mounting seat, a bearing retainer of U-shaped cross section having a pair of legs joined by a base, said legs extending transversely of said slots for receipt within said mounting seat for positioning adjacent inner surfaces of said legs and said base for cooperation with said slots to define a bearing surface rotatably engaging said hinge pin, and means engaging with said base for retaining said legs within said mounting seat.

8. A cabinet construction according to claim 7, wherein said means engaging with said base is resiliently deformable to permit snap-fit mounting of said bearing retainer within said mounting seat.

9. A cabinet construction according to claim 7, wherein said means engaging with said base are detents and said bearing retainer is formed of a material resiliently deformable sufficiently to permit snap-fitting of said base over and past said detents to position said legs within said mounting seat.

10. A cabinet construction according to claim 7, wherein said bearing retainer extends essentially between said upper and lower edge panels, said means engaging said base is a pair of detents projecting from facing surfaces of said upper and lower edge panels and arranged for engagement with an outer surface of said base when said legs are received within said mounting seat.

11. A cabinet construction according to claim 10, wherein said upper and lower edge panels are resiliently deformable sufficiently to permit snap-fitting of said base over and past said detents to position said legs within said mounting seat.

12. A cabinet construction according to claim 10, wherein said bearing retainer is formed of a plastic material resiliently deformable sufficiently to permit snap-fitting of said base over and past said detents to position said legs within said mounting seat.

13. A cabinet construction comprising a frame defining vertically aligned cabinet access openings; doors for closing said access openings; a common, vertically extending cylindrical hinge pin carried by said frame; and mounting means carried by each of said doors for removably, individually and selectively mounting said doors on said hinge pin for swinging movement between access opening closed and open positions without requiring removal of said hinge pin from said frame, said mounting means on each door including a pair of vertically aligned slots defined by upper and lower edge panels carried by said door, said slots having open ends facing rearwardly of said door and being sized to slidably receive said hinge pin through said open ends when said door is moved transversely of said hinge pin, a mounting seat on the said door adjacent said slots, a bearing retainer and means to removably attach said bearing retainer to said door within said seat to position said bearing retainer to extend across said open ends for releasably preventing withdrawal of said hinge pin therethrough, said bearing retainer and said slots cooperating to define a bearing surface surrounding said hinge pin for supporting said door on said hinge pin for said swinging movement.

14. A method of individually, removably attaching a plurality of doors to a common hinge pin carried by the frame of a cabinet without requiring removal of said hinge pin from said frame, which comprises:

providing each of said doors with a pair of edge panels having aligned slots, said slots having closed ends and open ends facing rearwardly of said door, said slots being sized to slidably receive said hinge pin through said open ends thereof when said door is moved transversely of said hinge pin;

providing a plurality of bearing retainers to be associated one with each of said doors, each of said bearing retainers having a bearing surface;

moving each of said doors to insert said hinge pin through said open ends of said slots to position said hinge pin adjacent said closed ends thereof; and removably attaching one of said bearing retainers to each of said doors after insertion of said hinge pin into said slots thereof for releasably preventing subsequent withdrawal of said hinge pin from within said slots and placing said bearing surface for cooperation with said slots to support said door for swinging movement relative to said hinge pin.

15. A method according to claim 14, wherein said bearing retainers are removably attached to said doors by providing said doors with mounting seats for said bearing retainers and by providing said edge panels with means cooperating with said bearing retainers to permit removably snap-fit mounting of said bearing retainers into said mounting seats for releasably preventing withdrawal of said hinge pin from within said slots.

* * * * *